United States Patent [19]

Herwander

[11] Patent Number: 5,073,204

[45] Date of Patent: Dec. 17, 1991

[54] HOT REMOVAL PROCESS FOR ASBESTOS INSULATION

[75] Inventor: David R. Herwander, St. Albert, Canada

[73] Assignee: Fuller Austin Insulation Inc., Edmonton, Canada

[21] Appl. No.: 534,955

[22] Filed: Jun. 8, 1990

[51] Int. Cl.[5] ..... B08B 5/04; B08B 9/00

[52] U.S. Cl. ..... 134/21; 134/22.1; 134/22.12; 134/24; 98/115.2; 454/49

[58] Field of Search ..... 134/21, 34, 22.1, 22.12, 134/24, 42; 98/115.2, 115.4

[56] References Cited

U.S. PATENT DOCUMENTS

| | | | |
|---|---|---|---|
| 4,351,863 | 9/1982 | Roesner | 98/115.2 |
| 4,774,974 | 10/1988 | Teter | 134/21 |
| 4,872,920 | 10/1989 | Flynn et al. | 134/30 |

*Primary Examiner*—Theodore Morris
*Assistant Examiner*—Saeed Chaudhry

[57] ABSTRACT

A hoarding assembly having a non-combustible innermost portion is sealed against the cladding of a hot surface, such as that of a large boiler, to create an envelope. Outside air may enter the otherwise airtight envelope through controlled inlets in the hoarding assembly. The boiler is insulated with a layer of asbestos that is to be replaced. A vertically extending first array of supply air inlets is provided in one end wall of the hoarding assembly and a vertically extending second array of suction outlets is provided in the other end wall. A fan assembly injects cool air through the first array and a negative air machine assembly withdraws air through the second array. The placement of the inlets and outlets results in a wall of air moving parallel to the boiler wall and having its centerline spaced from the cladding, typically about 1 to 3 feet from it. With the foregoing operating, the sheet metal cladding is removed from the boiler. A narrow vertical strip of the asbestos is then removed. Insulation or a ceramic fiber curtain is temporarily placed over each exposed strip of boiler wall, to contain the heat radiation. The asbestos is progressively removed in this fashion. A sealant is then sprayed on the bared cleaned wall. The system overcomes the problems inherent in removing asbestos from a potent source of radiant heat, without shutting the boiler down.

15 Claims, 4 Drawing Sheets

HOT REMOVAL PROCESS FOR ASBESTOS INSULATION

BACKGROUND OF THE INVENTION

1. Field of the Invention

This invention relates to method and apparatus useful in connection with removing asbestos insulation from a hot surface, such as that of the wall of a large industrial boiler.

2. Commercial Prior Art

As stated, the invention has been developed in connection with asbestos removal from boilers. For purposes of illustration, it will be described in that connection. However, it is to be understood that use of the invention can be extended to other insulated hot surfaces, such as plant ducts and piping. There is therefore no intention to restrict the scope of the invention to the field of boilers.

The boilers, in connection with which the invention has been developed, are large industrial units. Typically, the boiler might have a base that measures 30'×30' and a height of 60'. It is insulated with a layer of asbestos which is contained by an outer skin of sheet metal cladding. The temperature at the outer surface of the boiler steel wall can vary between about 275° F. and 700° F. The temperature of the cladding might be 130° F. Absent the cladding and insulation, the boiler obviously constitutes a potent source of radiant heat.

Since the 1960's, there has been an increasing awareness that asbestos creates a serious hazard to a human, if ingested. So plant operators having asbestos-insulated units are gradually removing the asbestos and replacing it with other insulating material.

Unfortunately, asbestos is a very difficult material to work with. The fibers are minute —they are too fine to be seen by the human eye. And they are readily airborne and can float in the air for days on end.

Heretofore, the removal of the asbestos from large industrial boilers has involved shutting down the unit and allowing it to cool, before initiating the asbestos removal process. We choose to refer to this conventional process as a "cold" removal process.

When the boiler is shut down for this purpose, there is naturally a loss of production in the plant as a whole. By way of example, in one forest products plant at which the present applicant carried out a cold removal, the lost production was valued at $41,000/hour.

At this point, it is appropriate to describe the conventional cold removal process:

As a first step, hoarding, comprising a wood frame covered with polyethylene sheeting, is erected and sealed with tape around the boiler. The sheeting is secured to the wood frame with lath and staples. All openings in the hoarding are sealed with adhesive tape. In effect, an envelope incorporating a supporting floor is applied. However, there are apertures in the hoarding, which are controlled by flaps. When suction is applied to the work chamber formed by the hoarding, the flaps open to allow a limited amount of outside air to enter the chamber. However, if the negative pressure is lost, the flaps normally close. Suitable sealed doors are also provided for entry into the work chamber. The envelope so formed is adapted to prevent the escape of air out of the chamber. This is essential as the plant workers outside the hoarding are not protected with protective breathing apparatus;

With the hoarding in place, a negative air machine assembly is provided, having one or more air outlets that are mounted in the hoarding wall. The negative air machine assembly functions to draw outside air into the chamber and to suction contaminated air from the chamber. This withdrawn contaminated air is filtered in three sequential stages in the assembly, to trap the fibers and discharge cleaned air. The negative air machine assembly is normally operated to maintain a negative air pressure of 0.05 to 0.08 inches of water in the chamber, relative to atmospheric pressure. The system is further typically operated to change the air in the chamber 4–5 times per hour;

With this system in place and operating, the workers, properly clothed and equipped with breathing apparatus, enter the chamber and remove the cladding. They then scrape off the insulation while simultaneously soaking it with a stream of water. The sodden clumps of asbestos are immediately bagged as they are removed. A steel brush is then used to polish the steel surface while a vacuum hose is held close to the brush to catch loosened fibers. As a final step, the cold steel surface of the cleaned wall is washed down with water using a high pressure sprayer and then sprayed with a liquid sealant that solidifies over time to form a solid coating that fixes remaining fibers of asbestos still clinging to the steel.

It is significant to note that wetting down the asbestos with water is an important part of the process, to keep fibers from becoming airborne.

It has long been recognized in the industry that it would be desirable to remove the asbestos without shutting down and cooling the boiler. (Hereinafter such a process is referred to as a 'hot removal process'.) Prior to the present invention, to the best of applicants'knowledge, no commercially applied hot removal process had been developed.

The objective of the work underlying the present invention was to successfully develop a feasible hot removal process.

In setting out to develop such a process, applicants were faced with the following problems: p0 (1) Upon removing a patch of cladding and underlying asbestos, an enormous source of heat is exposed to radiate heat into the work chamber, with any of the following possible results:

The plastic could melt,

The seals could be lost,

The hoarding frame could catch fire, or

The workers could be driven out by the heat; and (2) It would not be possible to soak the asbestos with water, as it would turn into steam. Steam damages the filters used in the breathing apparatus and in the negative air machines. The removal of the asbestos would therefore have to be carried out on a dry basis. It then follows that the incidence of floating asbestos fibers would be accordingly much greater.

With this background in mind, the present invention will now be described.

When the word "airtight" is used herein to describe the hoarding, it is used in the sense that air should not be able to escape out of the chamber formed by the hoarding.

SUMMARY OF THE INVENTION

There are two aspects to the present inventive system. The second aspect incorporates the first. More particularly, these aspects are directed toward:

(1) providing a relatively small, non-combustible, air-cooled hoarding, sealed to the hot clad wall, forming a chamber in which a human can safely and comfortably work in the course of removing asbestos; and (2) providing such a chamber and removing the asbestos in accordance with a specified procedure.

In greater detail, the inventive system incorporates some or all of the following features:

(a) The hoarding is relatively small in comparison to the hoarding typically used with a cold removal. For example, in the case of a 30'×30'×60' boiler the cold removal hoarding would commonly encapsulate the entire unit. The chamber of such a large hoarding might take up 18,000 cu. ft. In the present hot removal system, the hoarding typically might form a rectangular chamber having a volume of 1600 cu. ft. (typically 8' high, 8' wide and 10' long). Stated otherwise, the hot removal hoarding only covers a minor portion or patch of the hot surface being worked on;

(b) The hoarding is formed with a non-combustible innermost portion. Preferably, the noncombustible hoarding portion is formed of sheet metal and extends out about 3 feet from the cladding;

(c) A fan assembly is provided, preferably having a vertically extending array of air supply inlets mounted in the hoarding wall at one end of the chamber. The fan assembly is adapted to inject cool air (preferably having a temperature below 50° F.) into the chamber in sufficient amount to ensure that the wet bulb globe temperature ("WBGT") in the chamber is maintained at less than about 80° F.

(d) A suction assembly is provided at the other end of the chamber for withdrawing, cleaning and discharging air from the chamber while maintaining a negative air pressure therein, preferably in the order of 0.05 to 0.08 inches of water. Preferably, a battery of negative air machines is provided having a vertically extending array of suction outlets mounted in the hoarding wall at the other end of the chamber. The suction assembly is preferably operated to change the chamber air about 95 to 360 times per hour, as compared to the cold removal rate of 4 to 5 times per hour;

(e) Each of the centers of the fan assembly inlets and suction assembly outlets are preferably positioned to ensure that the centre of the air flow is about 1 to 3 feet out from the cladding. The air supply inlets are directed to send a stream of cool air laterally across the face of the wall. Stated otherwise, a stream of cool air, extending across substantially the full vertical extent of the chamber, moves parallel to the boiler wall and the center of the stream is spaced out from the wall.

It has been found that if the air stream is centered closer than about 1 foot from the cladding, excessive heat is picked up by the stream and the temperature within the chamber rises to unacceptable levels. If the stream is centered more than about 3 feet from the cladding, the workers, who stand about 2 feet from the cladding, are not sufficiently cooled by the stream, which is undesirable.

It has also been found that the stream needs to move parallel to the wall, in spaced arrangement therewith. If the stream is directed against the wall, air turbulence results and excessive heat is extracted from the wall; and (f) With (a) to (e) in place, the workers remove part or all of the enclosed cladding and begin to dry remove the asbestos, preferably in narrow vertical strips (typically 3 feet in width), which are only a minor portion of the enclosed patch. As each strip is removed, a temporary insulating member, which can be a batt of mineral fibre insulation or a curtain of ceramic fiber cloth, is placed over the bared hot metal. As a result, the area of heat-emitting exposed steel wall is kept relatively small.

By combining (a) to (f) inclusive:

Only a small volume chamber is involved, so that it becomes relatively easy to supply the desired high rates of air flow;

The hoarding has been modified to cope with the hot near-wall conditions and will not burn, melt or lose its seal;

The fact that dry removal of the asbestos will greatly increase the incidence of airborne asbestos has been coped with by massively expanding the rate of air flow, thereby maintaining the fiber concentration below acceptable leve ls when supplied air respirators are used by the workers;

The fact that heat is being supplied into the enclosure has been dealt with by supplying a moving wall of cool air and learning how the air stream should be directed. The moving wall of air keeps the temperature within the chamber at the desired level, immerses the workers, and ensures that dead air "hot spots"do not develop; and The area of exposed heat source has been minimized by using the narrow strip removal technique and temporarily insulating the increasing area of cleaned steel with the insulating members.

Broadly stated, the invention is a method for providing a work chamber in which a human can work to remove a cladded insulating asbestos layer from a hot wall, comprising: erecting a hoarding assembly having an innermost non-combustible portion sealed against the cladding, said hoarding assembly being adapted to provide an envelope and defining a work chamber; providing first means for injecting a stream of cool air through at least one air supply inlet located at one end of the chamber and spaced away from the cladding, said inlet being directed to supply the air stream generally parallel to the wall; providing second means, having at least one air outlet located at the other end of the chamber, for suctioning air from the chamber and maintaining a negative air pressure within the chamber relative to atmospheric pressure, removing entrained asbestos from the air, and discharging the cleaned air outside the envelope, said second means outlet and first means inlet being generally aligned; and actuating the first and second means to provide an air stream moving through the chamber, said air being withdrawn at a rate sufficient to ensure that between 95 and 360 chamber volumes of air move through the chamber per hour.

DESCRIPTION OF THE PREFERRED EMBODIMENT

Figure 4:
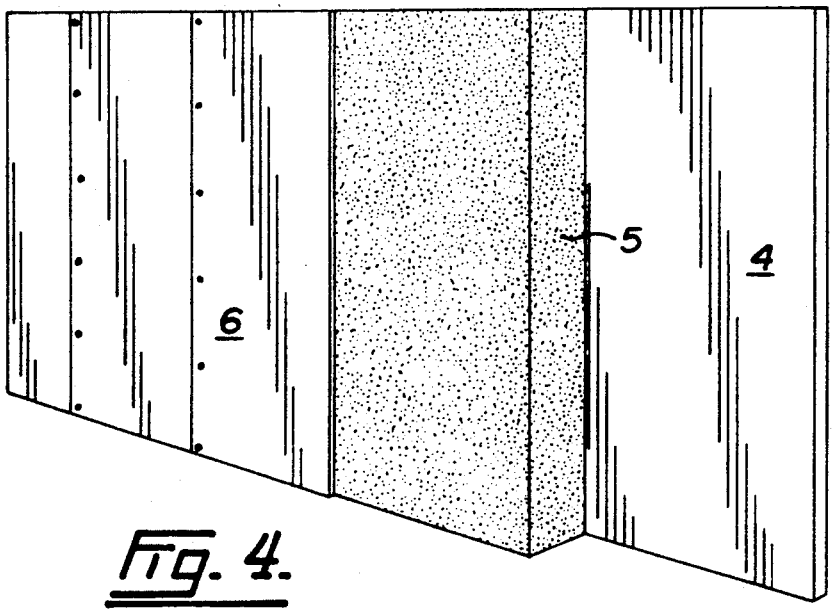
FIG. 4 is a perspective view showing part of a boiler wall having cladding and insulation secured thereto.

In the first step of applicant's hot removal process, a hoarding assembly 1 is erected to seal against the boiler 2 and create an envelope forming a working chamber 3. As shown in FIG. 4, the boiler 2 has a hot steel wall 4, a layer 5 of asbestos insulation covering the wall 4, and an outer skin of sheet metal cladding 6 containing the layer 5. The hoarding assembly 1 is supported by conventional scaffolding or the plant floor (neither of which is shown). A fan assembly 7 injects clean cool air into the chamber 3. Conventional, normally closed, flap-controlled apertures 7*a* admit additional air into the chamber 3 when suction is applied. A suction assembly 8 suctions the air from the chamber 3, maintains a negative air pressure in the chamber relative to atmospheric pressure, removes entrained asbestos from the air, and discharges the cleaned air outside the hoarding assembly 1.

In greater detail, an innermost non-combustible hoarding portion 9 is secured by screws to the cladding 6. The hoarding portion 9 is formed by a metal stud frame and galvanized sheet metal. It extends outwardly from the cladding 6 about 3 feet. High temperature caulking is used to seal the hoarding portion 9 to the cladding 6 and to seal the sheet metal segments one to another. A suitable caulking compound for this purpose is GE 1200, available from the General Electric Company.

The balance of the hoarding assembly 1 is conventional in construction. It is formed of a wooden frame and polyethylene sheeting. The sheeting is secured by lath and staples to the boards. Duct tape is applied to seal the plastic sheets to the frame and to each other. Sealed doors are provided for entry into the chamber 3. Air inlets 7*a*, controlled by hinged flaps 7*b*, are provided in the hoarding assembly 1, to allow air to enter the chamber 3 when suction is applied to it. The flaps 7*b* function to normally close the air inlets 7*a*. The air inlets 7*a* and flaps 7*b* combine t provide normally closed apertures for admitting supplemental air into the work chamber 3 when suction is induced.

In summary, the hoarding assembly 1 is airtight, as previously defined, and has a non-combustible portion 9 positioned adjacent the boiler 2.

The fan assembly 7 comprises a vertically extending array 10 of supply air inlets or louvers 11, mounted in one outwardly projecting end wall 12 of the hoarding portion 9. The louvers 11 are equipped with pivoting weighted doors or dampers 13 which normally close when the supply of pressurized air to the louver is terminated.

The supply air louvers 11 are connected by ducts 14 with a conventional fan system 15 adapted to supply cool air at the rate and temperature required to maintain the WBGT in the chamber below about 80° . The fan system 15 will typically involve an air conditioning component for use in warm weather.

The suction assembly 8 comprises a vertically extending array 16 of negative air machines 17, each having a suction outlet or louver 17*a* mounted in the other outwardly projecting end wall 18 of the hoarding portion 9. The suction louvers 17*a* are substantially aligned with the supply air louvers 11.

The suction assembly 8 is adapted and operated to withdraw air from the chamber 3 at a sufficient rate so as to maintain the negative air pressure in the chamber 3 at about 0.05 to 0.08 inches of water and maintain the number of air changes in the desirable range. The suction assembly 8 is further adapted to filter entrained asbestos fibers from the air as it passes therethrough.

Figure 1:
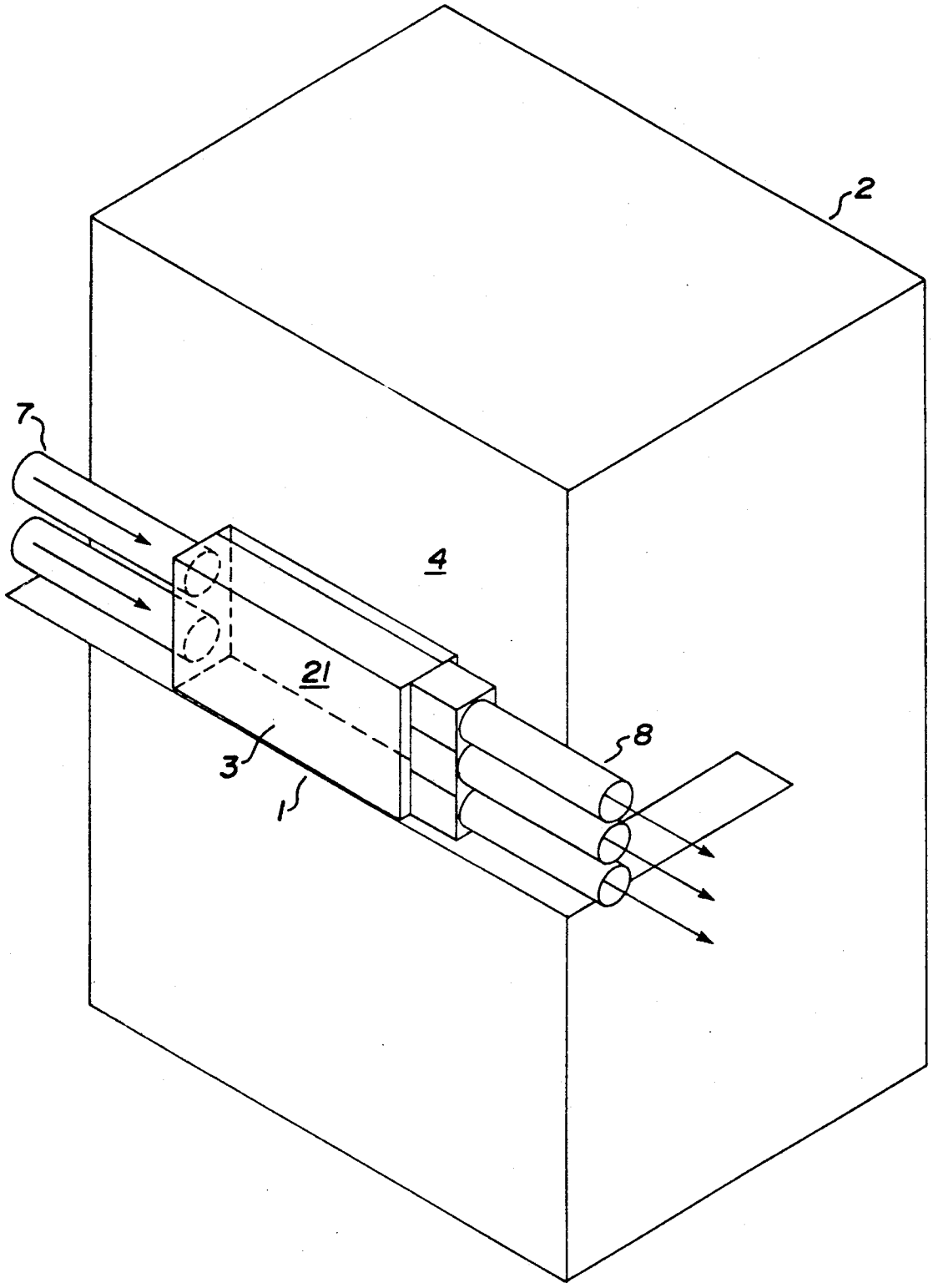
FIG. 1 is a simplified schematic perspective view showing a hoarding assembly applied to a patch of the wall of a boiler, the resultant envelope being connected with fan and negative air machine assemblies.
Figure 2:
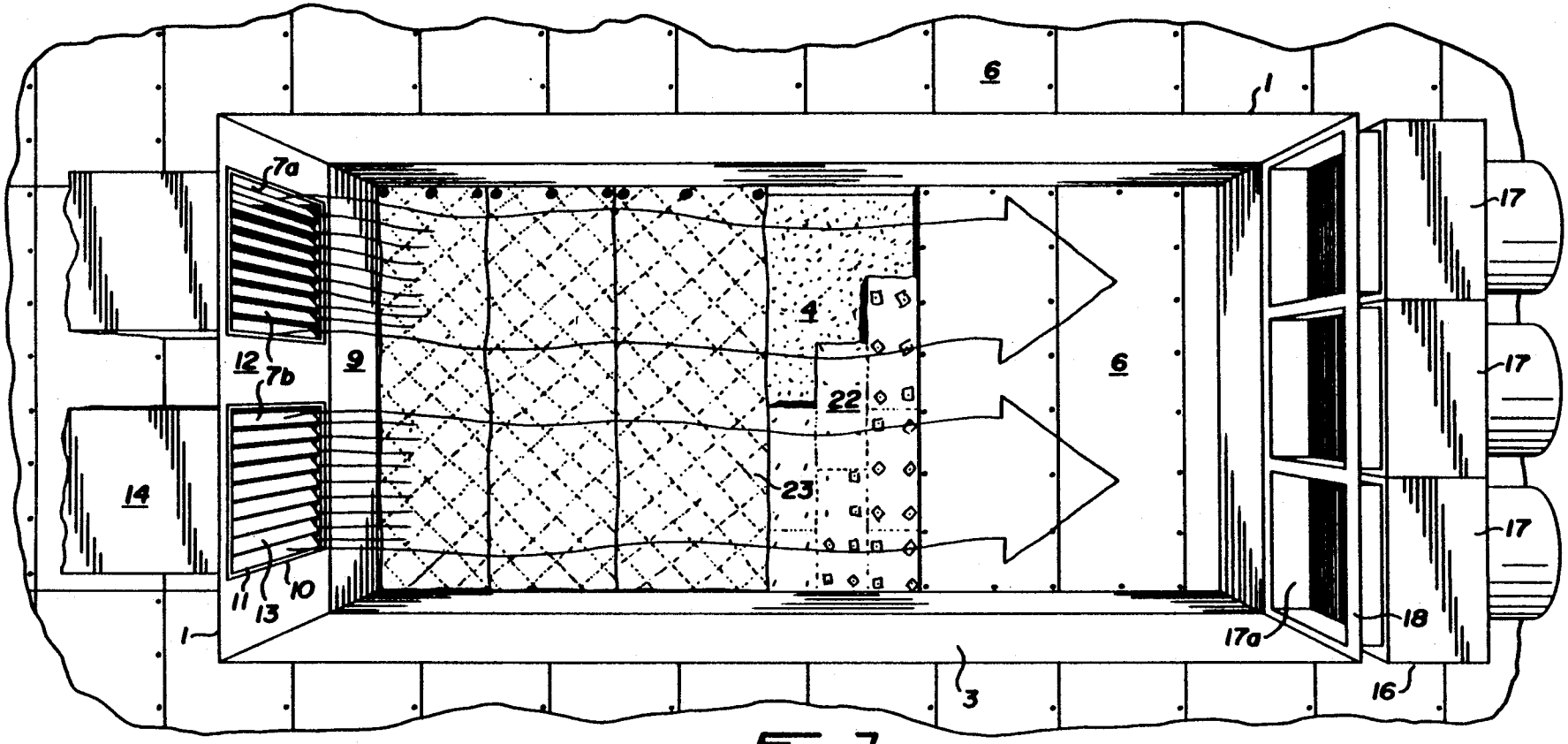
FIG. 2 is a front view of the hoarding envelope with the front wall removed and showing the fan duct inlet louvers, suction duct outlet louvers, the cladding, a bared patch of insulation and ceramic blankets covering cleaned patches —the air stream is indicated by arrows.
Figure 3A:
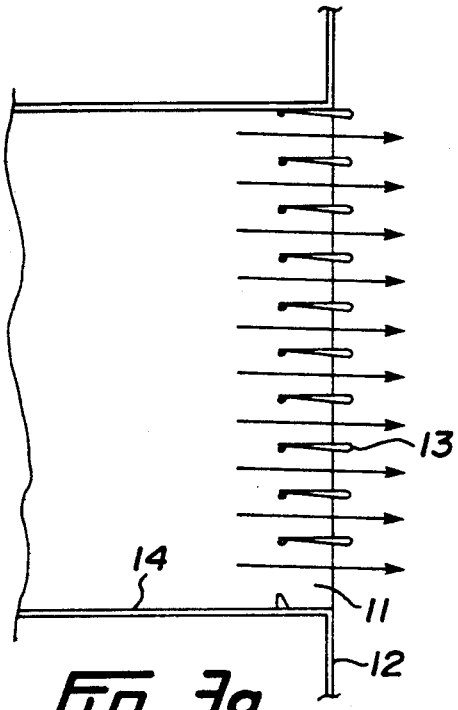
FIGS. 3*a* and 3*b* show the inlet louvre doors open in use and normally closed when air injection is stopped.
Figure 3B:
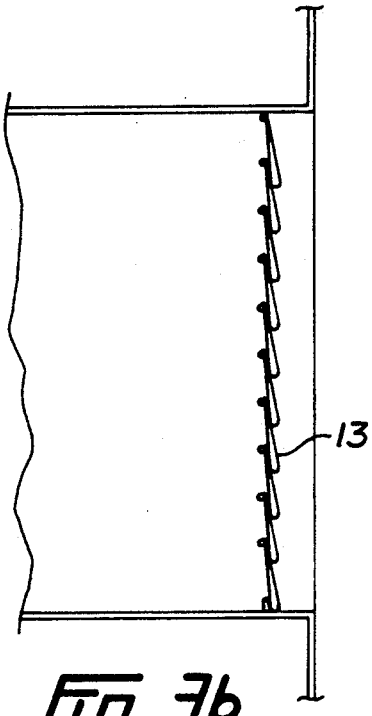

The fan and suction assemblies 7, 8 are functional to provide a wall or stream of cool air (indicated in FIG. 2 by arrows) moving across substantially the entire vertical extent of the enclosed boiler patch 21. The stream is centered about 2 feet from the cladding 6. A worker will normally stand this distance from the cladding and thus will receive maximum cooling. In addition, the air stream is spaced sufficiently from the hot wall 4 so as to avoid becoming overheated. One wants to maintain the air in the chamber 3 below about 80° WBGT and the asbestos fiber concentration below the value established by local regulations.

With the hoarding assembly 1 in place and the fan and suction assemblies 7, 8 operating, the workers remove a vertical section of the segmented cladding 6. The vertical section typically is 3 feet wide. The narrow exposed asbestos strip 22 is scraped off and bagged while at the same time a powerful vacuum hose (such as that of a Nilfisk 83* unit) is moved around at the removal area. Once the exposed asbestos strip 22 has been removed, a temporary insulating member 23 is positioned to cover the strip of now-exposed boiler wall 4. It has been found that, with a boiler wall at 640° F., the outer surface of an insulating member 23 formed of ceramic fiber cloth had a temperature of about 132° F. The foregoing procedure is repeated across the patch 21 until all of the asbestos has been removed. At this point, the members 23 are removed one at a time and a wire brush is used to polish the steel wall 4. Again, a vacuum hose is moved around the area being worked on. Once a particular strip has been polished, the member 23 is replaced. In this fashion, the patch 21 of asbestos is progressively removed and the exposed wall 4 is polished.

At this point, one or more of the members 23 is removed and bagged and a sealant is applied to the exposed strip of wall 4 to fix or bond residual asbestos fibers to the steel surface.

The sealant has to be able to:

bond to the hot surface; and solidify right away to form a durable solid coating that seals the asbestos fibres still clinging to the polished steel surface.

Figure 5:
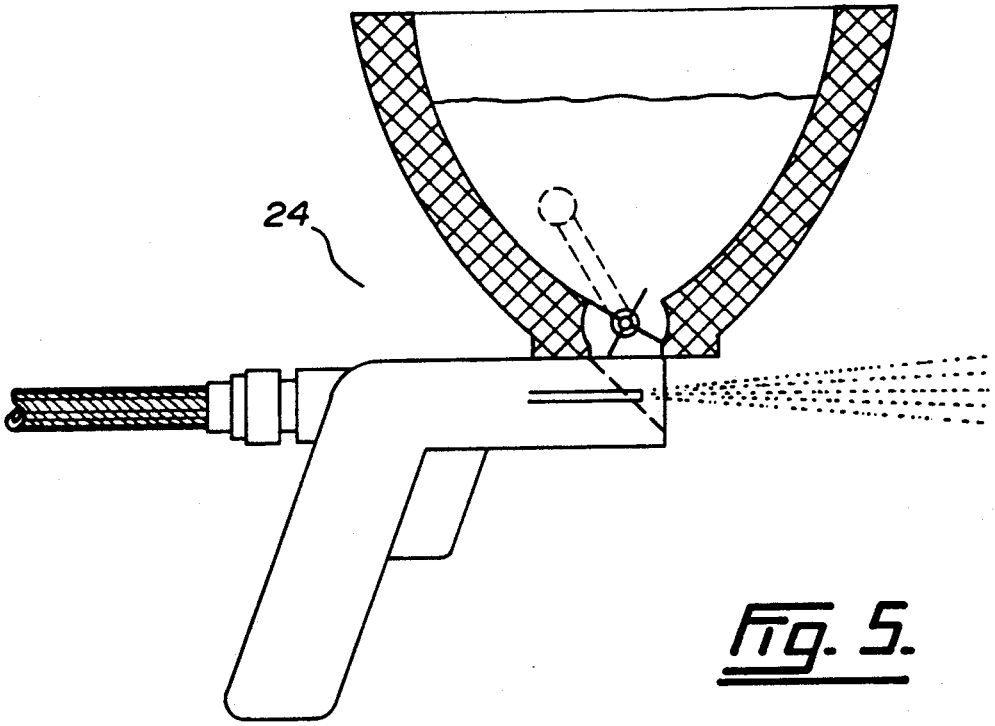
FIG. 5 is a simplified schematic side view of a gun assembly used to spray on the sealant.
Figure 6:
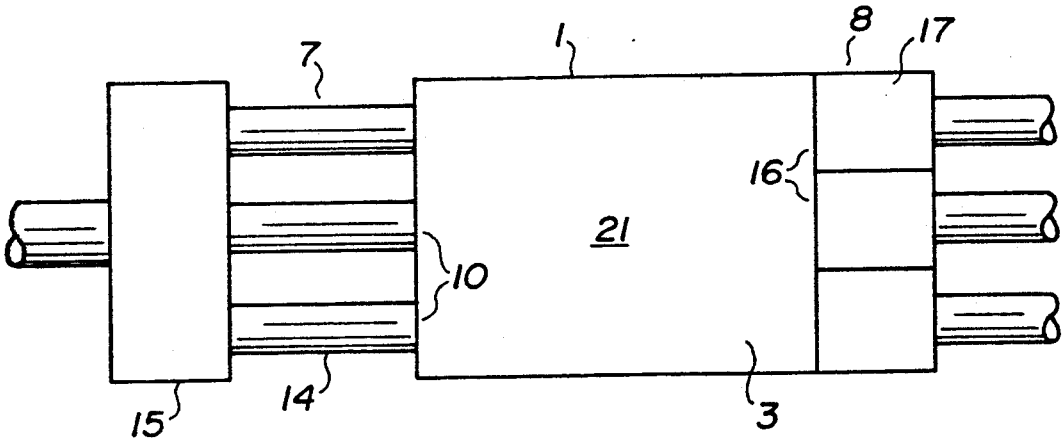
FIG. 6 is a simplified schematic setting forth the fan assembly, the hoarding assembly and the suction assembly.

A suitable sealant is manufactured by Gripcoat Industries Ltd., Edmonton, Alberta, and is identified by the designation Gripcoat FA-800. A gun 24 useful for applying the sealant is illustrated in FIG. 5.

By way of example, a 30'×30'×60' boiler, having a wall surface temperature of 400° F., had its asbestos insulation removed by workers operating with a system involving the following typical parameters:

hoarding dimensions: 8'×10'×20' size of inlet louvers: 16"×16"

number of inlet louvers: 2
spacing of centerline of inlet louvers from cladding: 3'
flow rate of injected air: 4600 CFM
typical temperature of injected air: 20° F.
size of outlet louvers: 24"×24"
number of outlet louvers: 6
spacing of centerline of inner bank of 3
outlet louvers from cladding: 2'
spacing of centerline of outer bank of 3 outlet louvers from cladding: 5'
air changes per hour: 360
typical WBGT temperature 2 feet from cladding: 55° F.
typical fiber concentration:
7 fibers/cc (personal sample)
0.001 fibers/cc (hoarding air sample) The scope of the invention is defined by the claims now following.

THE EMBODIMENTS OF THE INVENTION IN WHICH AN EXCLUSIVE PROPERTY OR PRIVILEGE IS CLAIMED ARE DEFINED AS FOLLOWS:

1. A method for providing a work chamber in which a human can work to remove a cladded insulating asbestos layer from a hot wall, comprising:

erecting a hoarding assembly having an innermost non-combustible portion sealed against the cladding, said hoarding assembly being adapted to provide an envelope and defining a work chamber;

providing first means for injecting a stream of cool air through at least one air supply inlet located at one end of the chamber and spaced away from the cladding, said inlet being directed to supply the air stream generally parallel to the wall;

providing second means, having at least one air outlet located at the other end of the chamber, for suctioning air from the chamber and maintaining a negative air pressure within the chamber relative to atmospheric pressure, removing entrained asbestos from the air, and discharging the cleaned air outside the envelope, said second means outlet and first means inlet being substantially aligned; and actuating the first and second means to provide an air stream moving through the chamber, said air being withdrawn at a rate sufficient to ensure that between 95 and 360 chamber volumes of air move through the chamber per hour.

2. The method as set forth in claim 1 wherein:

the hoarding assembly has normally closed apertures for admitting supplemental air into the work chamber when suctioning is induced; and the injected air has a temperature below about 50° F.

3. The method as set forth in claim 2 wherein:

the air inlets are centered about 1 to 3 feet from the cladding.

4. The method as set forth in claim 3 wherein:

the first means comprises a fan assembly having a vertically extending array of air supply inlets mounted in one end wall of the hoarding assembly, for supplying a stream of air that covers substantially the entire extent of the wall to be treated; and the second means comprises a suction assembly having a vertically extending array of negative air machines whose air outlets are mounted in the other end wall of the hoarding assembly, said inlet array being substantially aligned with said outlet array.

5. The method as set forth in claim 4 wherein:

the hoarding assembly encloses only a minor portion of the hot wall to be treated.

6. The method as set forth in claim 2 wherein:

the first means comprises a fan assembly having a vertically extending array of air supply inlets mounted in one end wall of the hoarding assembly, for supplying a stream of air that covers substantially the entire extent of the wall to be treated; and the second means comprises a suction assembly having a vertically extending array of negative air machines whose air outlets are mounted in the other end wall of the hoarding assembly, said inlet array being substantially aligned with said outlet array.

7. The method as set forth in claim 6 wherein:

the hoarding assembly encloses only a minor portion of the hot wall to be treated.

8. The method as set forth in claim 1 wherein:

the first means comprises a fan assembly having a vertically extending array of air supply inlets mounted in one end wall of the hoarding assembly, for supplying a stream of air that covers substantially the entire vertical extent of the enclosed wall to be treated; and the second means comprises a suction assembly having a vertically extending array of negative air machines whose air outlets are mounted in the other end wall of the hoarding assembly, said inlet array being substantially aligned with said outlet array.

9. A method for hot removal of a cladded asbestos layer from a hot wall, comprising:

(a) erecting a hoarding assembly having an innermost non-combustible portion sealed against the cladding, said hoarding assembly being adapted to provide an envelope enclosing only a minor portion of the hot wall and defining a work chamber;

(b) providing a fan assembly for injecting a stream of cool air through at least one air supply inlet located at one end of the chamber, said inlets being directed to supply the air stream generally parallel to the wall;

(c) providing second means, having at least one air outlet located at the other end of the chamber, for suctioning air from the chamber and maintaining a negative air pressure within the chamber relative to atmospheric pressure, removing entrained asbestos from the air, and discharing the cleaned air outside the envelope; where the fan assembly air supply inlets are centered about 1 to 3 feet from the cladding; and the second means air outlets are substantially aligned with said inlet so that the air stream moves substantially parallel with the hot wall;

(d) actuating the fan assembly and second means to provide an air stream moving through the chamber, said air being supplied and withdrawn at a sufficient rate to ensure that the temperature about 2 feet from the wall remains below about 80° WBGT;

(e) removing at least part of the enclosed cladding;

(f) removing a narrow strip of the exposed asbestos, on a dry basis, said strip being only a minor portion of the enclosed asbestos;

(g) covering the exposed strip of bared wall with a removable insulating member; and (h) repeating steps (f) and (g) to gradually remove the exposed asbestos.

10. The method as set forth in claim 9 wherein:

the hoarding aperture has normally closed apertures for admitting supplemental air into the work chamber when suctioning is induced; and in step (d) the air is withdrawn at an hourly rate sufficient to move a volume of air, through the chamber, which is at least 95 times the volume of the chamber.

11. The method as set forth in claim 10 wherein:

the fan assembly has a vertically extending array of air supply inlets mounted in one hoarding assembly end wall, the second means comprises a suction assembly having a vertically extending array of negative air machines whose air outlets are mounted in the other end wall of the hoarding assembly;

said vertical arrays being generally aligned;

whereby the stream of cool air extends across substantially the full vertical extent of the section of wall being worked on.

12. The method as set forth in claim 9 wherein:

the fan assembly has a vertically extending array of air supply inlets mounted in one hoarding assembly end wall, the second means comprises a suction assembly having a vertically extending array of negative air machines whose air outlets are mounted in the other end wall of the hoarding assembly;

said vertical arrays being substantially aligned;

whereby the stream of cool air extends across substantially the full vertical extent of the section of wall being worked on.

13. The method as set forth in claim 12 wherein:

the injected air has a temperature below about 50° F.

14. The method as set forth in claim 9 wherein:

the fan assembly has a vertically extending array of air supply inlets mounted in one hoarding assembly end wall, the second means comprises a suction assembly having a vertically extending array of negative air machines whose air outlets are mounted in the other end wall of the hoarding assembly;

said vertical arrays being substantially aligned;

whereby the stream of cool air extends across substantially the full vertical extent of the section of wall being worked on;

15. The method as set forth in claim 12, 14 or 11 wherein:

the injected air has a temperature below about 50° F.

* * * * *